US005221225A

United States Patent [19]

Newbold et al.

[11] Patent Number: 5,221,225

[45] Date of Patent: Jun. 22, 1993

[54] MOTION RESPONSIVE MUSICAL TOY

[75] Inventors: Roger Newbold, Garden Grove; Harry Lebo, Redondo Beach; Brett M. Bogar, Torrance, all of Calif.

[73] Assignee: Mattel, Inc., El Segundo, Calif.

[21] Appl. No.: 930,578

[22] Filed: Aug. 17, 1992

[51] Int. Cl.[5] ..... A63H 5/00; A63H 15/06

[52] U.S. Cl. ..... 446/297; 446/325; 446/397; 446/485

[58] Field of Search ..... 446/297, 325, 326, 397, 446/396, 484, 485, 303

[56] References Cited

U.S. PATENT DOCUMENTS

| | | | |
|---|---|---|---|
| 1,709,841 | 4/1929 | Da Costa . | |
| 1,789,333 | 1/1931 | Da Costa . | |
| 2,554,516 | 5/1951 | Anthony | 446/325 |
| 2,611,214 | 9/1952 | Schur | 446/325 |
| 2,780,029 | 2/1957 | Anthony | 446/409 |
| 3,304,651 | 2/1967 | Deyerl | 446/485 |
| 3,580,575 | 5/1971 | Speeth | 446/485 X |
| 3,935,669 | 2/1976 | Potrzuski et al. | 446/485 |
| 4,662,260 | 5/1987 | Rumsey | 446/408 X |
| 4,737,134 | 4/1988 | Rumsey | 446/409 |
| 4,801,141 | 1/1989 | Rumsey | 273/1 E |
| 4,931,029 | 6/1990 | Hwang | 446/396 |
| 5,049,107 | 9/1971 | De Nittis | 446/397 |
| 5,066,011 | 11/1991 | Dykstra et al. | 446/485 X |

FOREIGN PATENT DOCUMENTS

| | | | |
|---|---|---|---|
| 33434 | 11/1964 | German Democratic Rep. | 446/485 |

*Primary Examiner*—Mickey Yu
*Attorney, Agent, or Firm*—Roy A. Ekstrand

[57] ABSTRACT

A motion responsive musical toy includes a generally spherical housing having a transparent hemispherical portion within which a center column supports a conventional musical tone producing circuit together with an output speaker. A motion sensing switch is operatively coupled to the tone producing circuit. A plurality of translucent floor segments are supported within the transparent housing interior and resiliently support a plurality of toy figures. A plurality of externally accessible push buttons are supported upon the periphery of the spherical housing near its center and are actuatable by inward pressure thereon. A plurality of conventional electric lamps are supported beneath the translucent floor segments to provide selective illuminations thereof. The musical toy responds to toy motion sensed by motion switch as well as the operation of the push buttons to provide oscillation of the toy figures together with a pattern of flashing lights and musical tones for the child user's amusement.

6 Claims, 2 Drawing Sheets

MOTION RESPONSIVE MUSICAL TOY

FIELD OF THE INVENTION

This invention relates generally to musical toys and particularly to those housed within a spherical ball.

BACKGROUND OF THE INVENTION

Musical toys comprise what may be one of the oldest types of toys known in the art. Early musical toys utilized relatively expensive and complex mechanical apparatus for producing musical sounds. Such apparatus tended to be relatively cumbersome and often easily damaged. As a result, the character of musical toys was for many years restricted from general application and use. However, the recently developed integrated circuit music producing systems have provided a plentiful supply of relatively inexpensive and durable electronic circuits for producing music and other sound amusement. As a result, a great variety of music and sound producing toys has been provided in various shapes and configurations. One of the most interesting types of musical toys is that in which a spherical ball is provided with an internal battery powered sound producing mechanism.

For example, U.S. Pat. No. 4,662,260 issued to Rumsey sets forth a SOUND PRODUCING BALL having a sound producing device producing three different tones when rotated. Three orthogonally mounted gravity switches produces signals corresponding to their orientation and a multiplexor coupled to the switches selects one output condition for each combination of the switch output signals. The output of the multiplexor is coupled to an oscillator and speaker producing various tones in response to ball orientation.

U.S. Pat. No. 4,737,134 issued to Rumsey sets forth a SOUND PRODUCING BALL having a multiple tone sound producing circuit. A light transducer is supported at the surface of the ball and produces signals corresponding to the amount of illuminating light sensed by the transducer. An oscillator is coupled to the light transducer to produce tones used to drive a speaker. A motion switch is coupled to the oscillator to shut off the production of sound when the device has been at rest for a predetermined time interval.

U.S. Pat. No. 4,801,141 issued to Rumsey sets forth a LIGHT AND SOUND PRODUCING BALL which produces light in one or more areas of a ball in response to orientation of the ball with respect to gravity. A tone generator and speaker are included with the ball to provide unique audio tones for each orientation of the device. Switches and timers are provided to control the volume output and rate of generation of tones and light signals by movement of the ball through a predetermined series of positions thereby obviating the need for external switches.

U.S. Pat. No. 2,780,029 issued to Anthony sets forth a TOY HEMISPHERE WITH MUSIC BOX THEREIN in which a hollow ball separable into a pair of hemispheres includes a diametrically extending interior bracket in each of the hemispheres. A music box is supported on the underside of one bracket and a threaded fastener cooperates with the brackets to secure the hemispheres together to form a music box enclosing sphere.

U.S. Pat. No. 3,304,651 issued to Deyerl sets forth an INTERMITTENTLY AND SELECTIVELY ILLUMINATED BALL in which a hollow sphere defines a plurality of light transmissive elements in its outer surface. A corresponding plurality of lightbulb supports and reflectors are positioned within the ball interior so as to illuminate the light transmissive portions. A battery power supply and a plurality of position responsive switches are provided to illuminate the electric lamps in response to ball motion and position.

U.S. Pat. No. 3,580,575 issued to Speeth sets forth a GAME DEVICE INCLUDING SELECTIVELY IMPACT OPERABLE LIGHTS having a hollow ball capable of withstanding external impact within which a switch device is supported. The switch device comprises a plurality of fixed contacts having a movable contact enclosed therein. A plurality of electric lights and a battery power source are included within the ball interior. The resulting structure selectively illuminates one or more of the interior lights in response to the direction of impact sensed by the motion switch.

U.S. Pat. No. 3,935,669 issued to Potrzuski, et al. sets forth an ELECTRICAL SIGNAL MECHANISM ACTUATED IN RESPONSE TO ROTATION ABOUT ANY OF THREE AXES in which an object such as a baton, a ball or the like produces an output signal such as sound or light solely when the object is rotated. The object includes an internal power source together with a plurality of centrifugal force responsive switches operatively coupled thereto. The internal electric mechanism is actuated in response to the centrifugal switches detecting ball motion.

U.S. Pat. No. 4,931,029 issued to Hwang sets forth a MUSICAL TOY TUMBLER in which a generally egg-shaped toy supports an ornamental head portion and is weighted so as to maintain a generally vertical orientation with the head extending upward. A sound generating integrated circuit and a plate spring type microswitch are supported within the base of the toy tumbler. The microswitch turns off the sound generating integrated circuit in the absence of rocking motion for a predetermined period of time.

U.S. Pat. No. 5,049,107 issued to DeNittis sets forth a SOUND BOX DEVICE in which a spherical container is provided with a service depicting a plurality of graphic fields or areas. A corresponding plurality of electrical contact sets are positioned beneath the graphic fields and coupled to a microprocessor within the container. A loud speaker and circuitry within the spherical container respond to the switch contact operation by producing a correspondingly related sound sequence.

U.S. Pat. No. 5,066,011 issued to Dykstra, et al. sets forth a FLASHING LIGHT BALL in which a bounceable ball includes an activatable light in the form of a flash tube which flashes when the ball incurs a physical jolting such as when being bounced. A sound annunciator produces a sound simultaneously with the flashing light in response to bouncing.

U.S. Pat. Nos. 1,709,841 and 1,789,333 issued to DaCosta set forth a TONE PRODUCING TOY and a TOY respectively having a hollow spherical ball within which a mechanically actuatable weight responsive sound producing mechanism is disposed.

U.S. Pat. No. 2,611,214 issued to Schur sets forth a ROLY-POLY TOY in which a hollow spherical base supports a battery-powered light source. A weight is positioned within the hollow interior to bias the toy to a vertical position. A spherical head is secured to the uppermost portion of the spherical base to resemble a fanciful doll or the like.

While the foregoing described musical toys have provided some increase in amusement and play value for toys generally, there remains a continuing need in the art for evermore improved interesting and amusing musical toys.

SUMMARY OF THE INVENTION

Accordingly, it is a general object of the present invention to provide an improved musical toy. It is a more particular object of the present invention to provide an improved musical toy which is motion responsive and which provides increased visual amusement and activity.

In accordance with the present invention, there is provided a motion-responsive musical toy comprises: a housing defining a lower surface, a transparent upper surface and an interior cavity; a plurality of colored floor segments supported within the interior cavity each formed of a different color light transmissive material; a plurality of toy figures; resilient support means for resiliently supporting the toy figures upon the floor segments so as to view through the transparent upper surface; illumination means for illuminating the floor segments supported beneath the floor segments; a plurality of push operable switches supported upon the lower surface; motion sensing means; and musical tone producing means, the motion sensing means activating the illumination means and the musical tone producing means in response to motion or change of orientation of the housing and the toy figures undergoing oscillatory motion.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
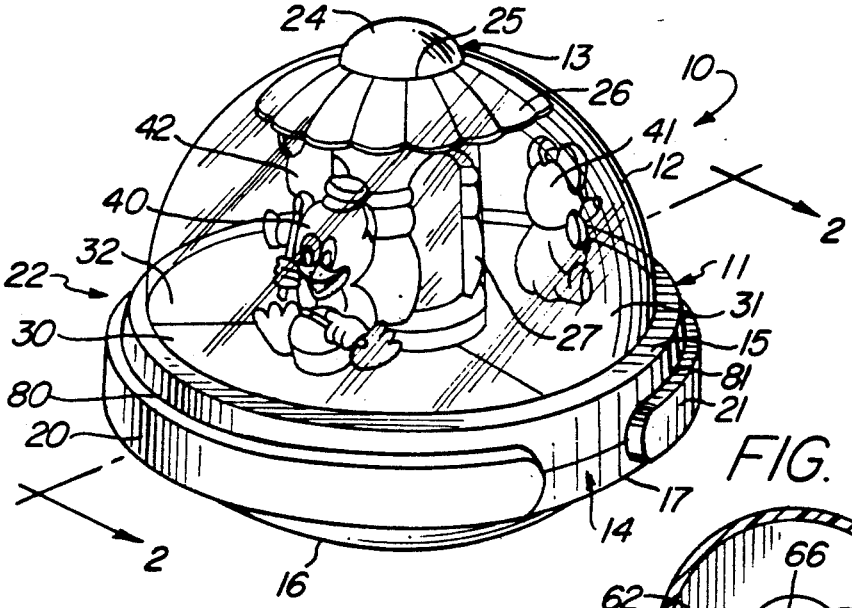
FIG. 1 sets forth a perspective view of a motion responsive musical toy constructed in accordance with the present invention.

FIG. 1 sets forth a perspective view of a musical toy constructed in accordance with the present invention and generally referenced by numeral 10. Musical toy 10 includes a generally spherical housing 11 having a hemispherical top 12 defining an aperture 25 and preferably formed of a clear transparent material such as molded plastic or the like. Housing 11 further includes a generally hemispherical base 14 having a convex bottom portion 16 and a circular ridge 17. An annular rim 15 is coupled to ridge 17 of base 14 and secures spherical top 12 to base 14 in the manner described below in greater detail.

Toy 10 further includes a plurality of curved depressible buttons 20, 21 and 22 (the latter seen in FIG. 4) supported upon ridge 17 and rim 15 in an equally spaced relationship. Musical toy 10 further includes a trio of floor segments 30, 31 and 32 generally spaced in accordance with buttons 20, 21 and 22 respectively. A trio of toy FIGS. 40, 41 and 42 are resiliently supported above floor segments 30, 31 and 32 respectively in the manner set forth below in greater detail. A center housing 27 having a generally cylindrical shape extends upwardly through the center portion of toy 10 and supports a cap 13. A dome portion 24 extending upwardly through aperture 25 of spherical top 12 and a downwardly extending curved shroud 26 which extends beneath spherical top 12. As is better seen in FIG. 2, toy 10 further includes a musical tone circuit 70 supported within center housing 27.

In operation, toy 10 is generally balanced by means set forth below in greater detail to rest upon a play surface in the vertical orientation shown in FIG. 1 such that the lowermost portion of convex bottom portion 16 supports toy 10. However, the curvature of convex bottom portion 16 permits toy 10 to be disturbed from the vertical orientation shown in FIG. 1 by the child user's contact. As the child user disturbs the vertical orientation of toy 10, the resulting motion causes toy FIGS. 40, 41 and 42 to oscillate back and forth due to the spring suspension thereof (better seen in FIG. 2). Concurrently, a motion switch (seen in FIG. 2) is operatively coupled to the music tone circuit to operate the musical tone circuit. In accordance with the user's selection, toy 10 is operable in a first mode in which the movement of toy 10 is sensed by the motion switch and causes a predetermined musical sequence of notes to be played. In an alternate mode of operation, the motion switch is used solely to activate the musical tone circuit within the toy. In either event, each musical tone is accompanied by the activation of a corresponding light beneath floor segments 30, 31 or 32 to produce illumination of the floor segments in correspondence to the notes being played. Floor segments 30, 31 and 32 are preferably formed of differently colored translucent materials such as molded plastic. As a result, the musical notes produced by toy 10 are accompanied by the illumination of one of floor segments 30 through 32. In addition, curved buttons 20 through 22 are coupled to the musical tone circuit within toy 10 in accordance with conventional fabrication techniques such that the pressing of each of curved buttons 20 through 22 produces a corresponding musical tone. Thus, musical toy 10 provides several sources of stimulation and activity simultaneously through the production of musical tones, the illumination of floor segments 30 through 32, the oscillations of toy FIGS. 40 through 42 and the interactive capability of curved buttons 20 through 22. As a result, toy 10 provides an improved entertaining interactive musical toy which responds to motion as well as push button activation to provide multi-faceted entertainment for the child user.

Figure 2:
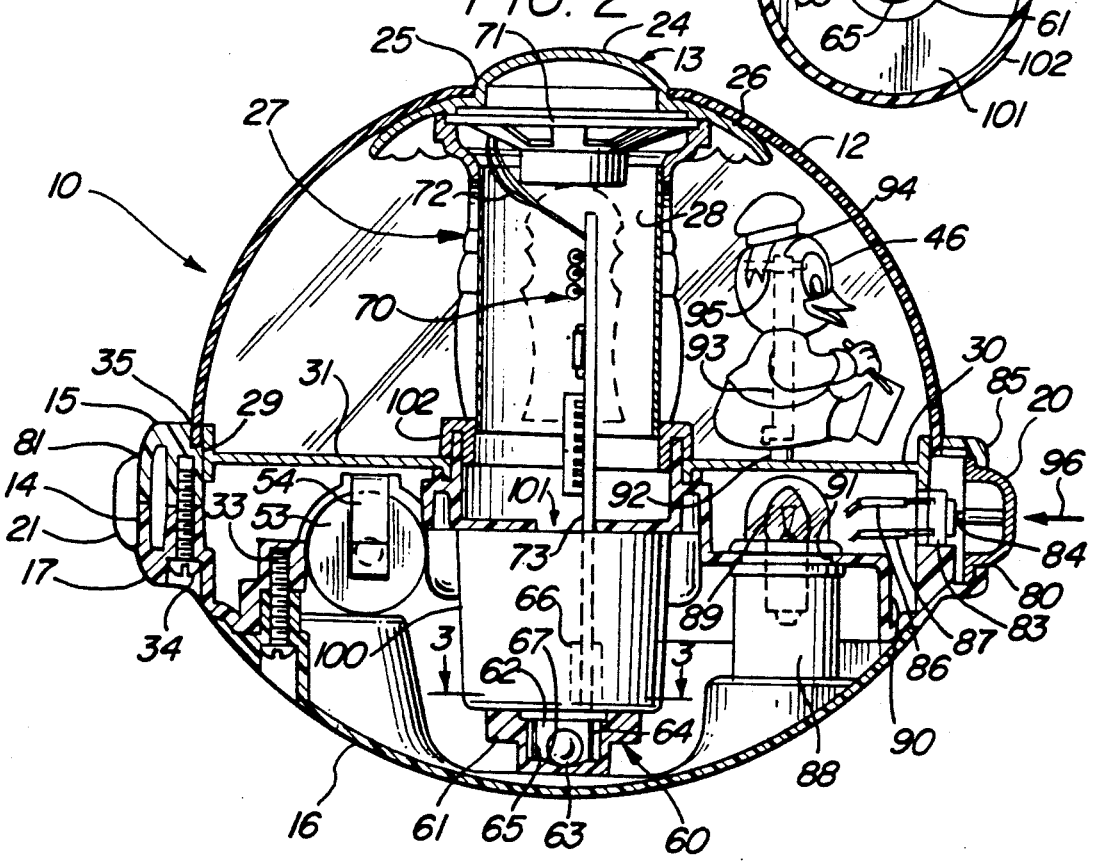
FIG. 2 sets forth a section view of the present invention motion responsive musical toy taken along section lines 2—2 in FIG. 1.

FIG. 2 sets forth a section view of musical toy 10 taken along section lines 2—2 in FIG. 1. Toy 10 includes a spherical top 12 preferably formed of a transparent molded plastic material or the like. Top 12 defines a center aperture 25 and a lower edge 29. A base member 14, preferably formed of a molded plastic material or the like, defines an annular ridge 17 and a center receptacle 100. Receptacle 100 supports a downwardly extending switch housing 61 which in turn defines an interior cavity 62 secured to the underside of center receptacle 100. Center receptacle 100 further defines a generally cylindrical interior cavity 101. A plurality of electrical contacts 64, 65 and 66 are supported in an equally spaced relationship within cavity 62. Cavity 62 further defines a downwardly extending recess 67. A metal ball 63 is received within recess 67 and cavity 62.

Base 14 further includes a plurality of lamp retainers such as lamp retainer 90 which in turn define a corresponding plurality of apertures such as aperture 91. A lamp socket 88 constructed in accordance with conventional fabrication techniques is received and supported within aperture 91 of lamp retainer 90. A conventional electric bulb 89 is received and supported within socket 88. Base 14 further receives and supports a plurality of conventional batteries such as battery 53 having appropriate electrical connections thereto such as connector 54.

A convex bottom portion 16 is secured to the undersurface of base 14 by a plurality of fasteners such as fastener 33 in an otherwise conventional attachment. An annular rim 15 is received upon and secured to the upper portion of base 14 by a plurality of fastener 34 in a conventional attachment. Rim 15 defines an annular groove 35 which receives lower edge 29 of spherical top 12.

Toy 10 further includes a generally cylindrical housing 27 supported within spherical top 12 and defining an interior cavity 28. Interior cavity 28 of center housing 27 is generally concentric with interior cavity 101 of center receptacle 100. A retaining ring 102 encircles the lower end of center housing 27 and is received upon the upper edge of center receptacle 100.

A musical tone circuit 70 constructed in accordance with conventional fabrication techniques includes a printed circuit board 73 having a connector 66 on the lower end thereof. Connector 66 provides electrical connection to motion switch 60 and serves to partially support printed circuit board 70 within interior cavities 28 and 101. While not seen in FIG. 2, printed circuit board 73 should be understood to be further supported within cavities 28 and 101 in accordance with conventional fabrication techniques. A conventional speaker 71 is supported on the upper portion of center housing 27 and is coupled to musical tone circuit 70 by a plurality of electrical wires 72. A cap 13 preferably formed of a molded plastic material or the like is received upon center housing 27 and captivates speaker 71. Cap 13 includes a domed portion 24 extending upwardly through aperture 25 in spherical top 12 and an outwardly extending downwardly curved shroud portion 26 which extends downwardly within spherical top 12 beyond the upper edge of center housing 27.

As described above, the circular member formed by ridge 17 of base 14 and rim 15 defines a plurality of elongated apertures 80, 81 and 82. A corresponding plurality of elongated curved buttons 20, 21 and 22 are received within apertures 80, 81 and 82 respectively. A corresponding plurality of floor segments 30, 31 and 32 are supported in general alignment with buttons 20, 21 and 22 respectively. A plurality of toy FIGS. 40, 41 and 42 are received upon and supported above floor segments 30, 31 and 32 respectively. Thus, with temporary reference to FIG. 1, it should be noted that the combination of an elongated aperture within rim 15 and ridge 17 together with a curved elongated button, a floor segment and a toy figure is repeated three times in toy FIG. 10. Thus, returning to FIG. 2, it will be apparent to those skilled in the art that the combination of toy FIG. 40, floor segment 30, aperture 80 and curved button 20 is repeated for the segments of toy FIG. 10 related to curved buttons 21 and 22 respectively.

Accordingly, a floor segment 30 preferably formed of a colored translucent molded plastic material is supported upon base 14 and extends for approximately one-third of the annular space between rim 15 and ring 102. A cylindrical boss 92 is supported upon the upper surface of floor segment 30 and receives an elongated spring 93. Spring 93 defines an end loop 94. A toy FIG. 40 preferably formed of a molded plastic material or the like defines a generally hollow member having a transversely extending pin 95 formed therein. Toy FIG. 40 is received upon spring 93 and secured thereto by the attachment of pin 95 within loop 94. Thus, toy FIG. 40 is resiliently suspended by spring 93 above floor segment 30. As a result, toy FIG. 40 is easily moved back and forth in an oscillatory manner each time the position or orientation of toy 10 is disturbed.

The configuration of lamp retainer 90 and aperture 91 within base 14 is formed directly beneath toy FIG. 40. As a result, lamp socket 88 and lamp 89 are also directly centered beneath toy FIG. 40. Thus, the light produced by energizing lamp 89 illuminates floor segment 30 which due to its translucent character glows with colored light corresponding to the color of floor segment 30.

Figure 4:
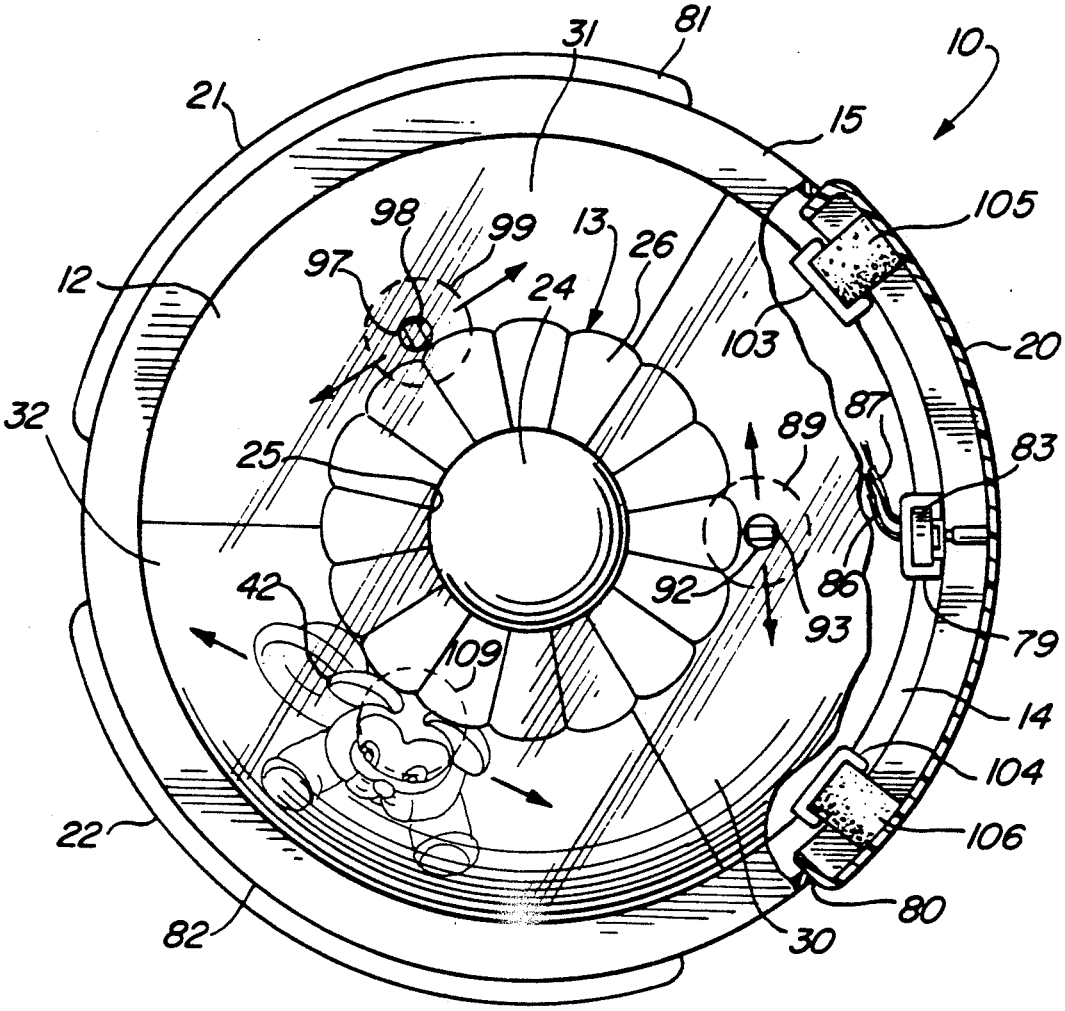
FIG. 4 sets forth a partially sectioned top view of the present invention motion responsive musical toy.

As is better seen in FIG. 4, curved button 20 is received within aperture 80 and by means seen in FIG. 4 is resiliently supported therein. Accordingly, curved button 20 defines an outwardly extending lip 85 which extends beneath aperture 80 and captivates curved button 20 against the interior surface of rim 15 and ridge 17. The resilient support of curved button 20 permits the inward motion of button 20 in the direction of arrow 96 by the child user. Curved button 20 further defines an inwardly extending post 84 which is generally centered upon curved button 20. A conventional push button switch 83 is supported by base 14 in alignment with post 84 of curved button 20 such that inward motion of curved button 20 causes post 84 to actuate switch 83. A pair of electric wires 86 and 87 connect switch 83 to musical tone circuit 80 in accordance with conventional fabrication techniques (not shown).

The combination of floor segment 30, toy FIG. 40, lamp 89, switch 83 and curved button 20 and the associated components related thereto shown in FIG. 2 is repeated a second and third time for the areas of toy FIG. 10 occupied by floor segments 31 and 32 respectively. Thus, each of toy FIGS. 40, 41 and 42 rests upon a floor segment having a corresponding lamp in association therewith to illuminate the floor segment and a corresponding curved button generally centered with respect to the toy figure. In addition, each of the toy FIGS. 41 and 42 is resiliently supported by a spring suspension similar to that provided for toy FIG. 40 by spring 93.

In operation, toy 10 is generally weighted to assume the vertical position shown in FIGS. 1 and 2 in the absence of a disturbing force. When so positioned, metal ball 93 rests within recess 67 of switch housing 61 and, as a result, motion switch 60 is open. In addition, with toy 10 at rest, toy FIGS. 40 through 42 are undisturbed and thus are generally motionless above their respective floor segments. The disturbance of the orientation or position of toy 10 causes metal ball 63 within motion switch housing 61 to be moved from recess 67 and under sufficient disturbance or motion contact a pair of contacts 64 through 66 (seen in FIG. 3). The closed circuit condition of motion switch provided by the bridging action of ball 63 provides a signal input to musical tone circuit 70. In one mode of operation, musical tone circuit 70 responds to the input signal from motion switch 60 to play a predetermined musical note sequence which is applied to speaker 71 to provide sound output for toy 10. In its preferred form, circuit 70 is operatively coupled to the trio of electric lamps such as lamp 89 in a manner associating each lamp with a corresponding musical note. Thus, as circuit 70 plays a succession of musical notes, it simultaneously energizes the corresponding electrical lamp to provide both a musical and visual entertainment response to motion switch 60. Thus, the child user observes the flashing of light from floor segments 30 through 32 accompanied by an associated series of musical tones. Simultaneously, the disturbance of toy FIG. 10 from its upright position imparts energy to toy FIGS. 40 through 42 which due to their resilience support upon their respective spring members begin oscillating back and forth to add further amusement and entertainment to toy 10.

In an alternative mode of operation, musical tone circuit 70 utilizes the signal inputs from curved buttons 20 through 22 to play a corresponding musical note and illuminate the associated one of the electrical lamps such as lamp 89. Thus, in this mode of operation, the child user's action of pressing a curved button such as curved button 20 causes musical tone circuit 70 to produce an associate musical tone and illuminate floor segment 30 by energizing lamp 89. This simple play pattern together with the oscillating motion of toy FIGS. 40 through 42 as the child user moves toy 10 about provides additional amusement and entertainment.

Musical tone circuit 70 is constructed in accordance with conventional fabrication techniques and, in its simplest form, provides a three tone output capability. It will be apparent to those skilled in the art that virtually any one of the presently available musical tone producing circuits may be utilized for musical tone circuit 70 without departing from the spirit and scope of the present invention.

Figure 3:
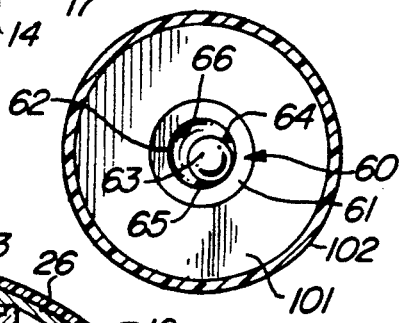
FIG. 3 sets forth a partial section view of the present invention motion responsive musical toy taken along section lines 3—3 in FIG. 2.

FIG. 3 sets forth a partial section view of toy 10 taken along section lines 3—3 in FIG. 2. As described above, center receptacle 100 defines a generally cylindrical member having an interior cavity 101 formed therein. A motion switch 60 is supported beneath center receptacle 100 and includes a switch housing 61 defining an interior cavity 62 therein. A plurality of electrical contacts 64, 65 and 66 are spaced within cavity 62 and cooperate with a metal ball 63 to provide a motion sensing switch. It will be apparent to those skilled in the art that the number and placement of contacts within switch housing 61 such as contacts 64 through 66 may be varied in accordance the particular design needs of switch 60. The important criteria of motion switch 60 is the provision of an electrical signal such as a contact bridging by ball 63 in response to the motion or disturbance of the position of toy 10.

FIG. 4 sets forth a partially sectioned top view of toy 10. As described above, toy 10 includes a generally spherical top 12 defining an aperture 25 and which is preferably formed of a transparent material such as molded plastic or the like. A plurality of floor segments 30, 31 and 32 are equally spaced about the interior of toy 10 and supported by an annular rim 15. A trio of curved buttons 20, 21 and 22 are positioned about the periphery of rim 15 and generally centered with respect to floor segments 30, 31 and 32 respectively. Buttons 20, 21 and 22 are supported within apertures 80, 81 and 82 defined in rim 15 and ridge 17 of base 14 (better seen in FIG. 2). A cap 13 includes a dome-shaped portion 24 extending upwardly through aperture 25 and a downwardly curved shroud 26. As described above, toy 10 includes a plurality of electric lamps 89, 99 and 109 supported beneath floor segments 30, 31 and 32 respectively. As is better seen in FIG. 1, toy 10 further includes a plurality of toy FIGS. 40, 41 and 42 supported in a centered relationship above floor segments 30, 31 and 32 respectively. The support structure for toy FIGS. 40 through 42 is set forth in greater detail in FIGS. 2 and 5. However, suffice to note here that toy FIG. 40 is supported by a cylindrical boss 92 and an elongated generally flat spring 93. Similarly, toy FIG. 41 is supported by a cylindrical boss 97 and an elongated generally flat spring 98 and finally toy FIG. 42 is supported by a cylindrical boss 112 and a generally flat elongated spring 114 (better seen in FIG. 5). It should also be noted that toy FIGS. 40 and 41 have been omitted from FIG. 4 to better show the positioning of cylindrical bosses 92 and 97 with respect to floor segments 30 and 31.

Base 14 further includes a switch receptacle 79 generally centered with respect to aperture 80 together with a pair of pad receptacles 104 and 105 equally spaced on either side of switch receptacle 79. A pair of resilient pads 105 and 106 are partially received within pad receptacles 103 and 104 respectively. Resilient pads 105 and 106 are preferably formed of a compressible resilient material such as plastic, foam or the like. Pads 105 and 106 are secured within receptacles 103 and 104 respectively using conventional attachment means such as adhesive materials or the like. The outwardly facing end of resilient pads 105 and 106 is secured to the undersurface of curved button 20 using conventional attachment means such as adhesives or the like. Thus, curved button 20 is resiliently supported by pads 105 and 106 and may be depressed inwardly by applying a force to the outer surface of curved button 20. A conventional push button switch 83 having connecting wires 86 and 87 is received and supported within switch receptacle 79. As described above, switch 83 is positioned in alignment with inwardly extending post 84 of curved button 20. Thus, inward pressure upon curved button 20 compresses one or both of resilient pads 105 and 106 permitting post 84 to actuate push button switch 83. It should be noted that the support mechanism for curved button 20 is particularly advantageous for use by younger children in that the activation of switch 83 occurs regardless of where the user presses curved button 20 inwardly. Thus, in the event the user presses curved button 20 near resilient pad 105, pad 105 is partially collapsed and curved button 20 tends to pivot about resilient pad 106 moving post 84 into contact with switch 83. Conversely, in the event child user presses the opposite end of curved button 20, resilient pad 106 is compressed and curved button 20 pivots about resilient pad 105 which also results in moving post 84 into operative contact with push button switch 83. Of course, inwardly pressing intermediate portions of curved button 20 between resilient pads 105 and 106 also moves post 84 into contact with switch 83 activating switch 83. It should be noted that the support structure and switch mechanism associated with curved button 20 and switch 83 is repeated for curved buttons 21 and 22 and thus buttons 21 and 22 are similarly operated.

Figure 5:
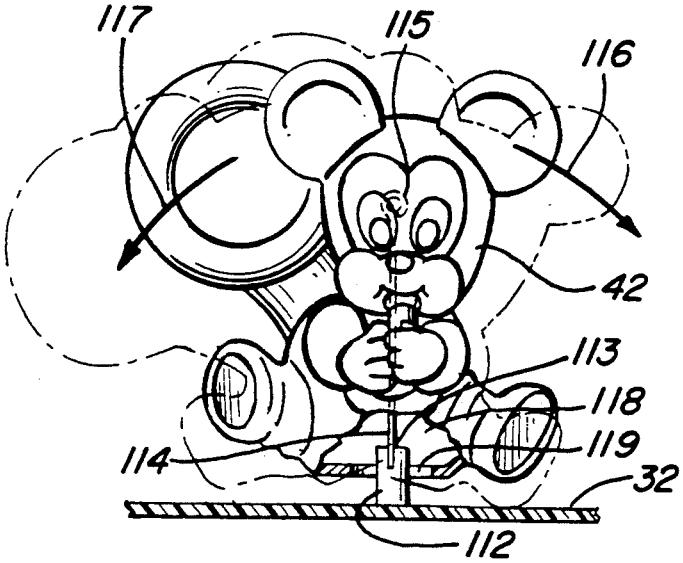
FIG. 5 sets forth a partial section view of the figure support portion of the present invention motion responsive musical toy.

FIG. 5 sets forth a partial section view of a typical toy figure support for the present invention motion responsive musical toy. It should be noted that while FIG. 5 sets forth the details of toy FIG. 42 and its support, the descriptions which follows apply equally well to the structures supporting toy FIGS. 40 and 41. Specifically, floor segment 32 supports an upwardly extending generally cylindrical boss 112 having a slot 113 defined therein. A resilient generally flat spring 114 is secured within slot 113 by conventional attachment means and extends upwardly from floor segment 32 terminating in a loop 115. A toy FIG. 42, preferably formed of a molded plastic material or the like, is generally hollow defining an interior cavity 118 and an aperture 119. Toy FIG. 42 receives spring 114 within interior cavity 118 through aperture 119. Aperture 119 is sufficiently large to permit toy FIG. 42 to move freely with respect to boss 112. As is better seen in FIG. 2, toy FIG. 42 is secured to spring 114 by an attachment to loop 115.

In operation, in the absence of motion of toy 10, spring 114 supports toy FIG. 42 in a generally vertical position. However, the disturbance or motion of toy 10 causes spring 114 to flex permitting toy FIG. 42 to move back and forth in an oscillatory manner in the directions indicated by arrows 116 and 117.

What has been shown is an improved motion responsive musical toy in which a combination of interesting and amusing sound and visual effects are provided which include flashing lights, musical tones, and oscillatory motions of toy figures within a clear viewing interior. The toy shown utilizes a conventional musical tone producing circuit together with a plurality of curved buttons and a motion sensing switch to facilitate easy interaction between the child user and the toy.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A motion-responsive musical toy comprising:

a housing defining a lower surface, a transparent upper surface and an interior cavity;

a plurality of colored floor segments supported within said interior cavity each formed of a different color light transmissive material;

a plurality of toy figures;

resilient support means for resiliently supporting said toy figures upon said floor segments so as to view through said transparent upper surface;

illumination means for illuminating said floor segments supported beneath said floor segments;

a plurality of push operable switches supported upon said lower surface;

motion sensing means; and musical tone producing means, said motion sensing means activating said illumination means and said musical tone producing means in response to motion or change of orientation of said housing and said toy figures undergoing oscillatory motion.

2. A motion-responsive musical toy as set forth in claim 1 wherein said housing further includes a generally cylindrical center housing within said transparent upper surface and having an interior cavity supporting said musical tone producing means.

3. A motion-responsive musical toy as set forth in claim 2 wherein said resilient support means include upwardly extending spring members coupled to said floor segments.

4. A motion-responsive musical toy as set forth in claim 3 wherein said upper and lower surfaces are generally hemispherical and are combined to form a generally spherical housing.

5. A motion-responsive musical toy as set forth in claim 4 wherein said motion switch includes:

a switch housing having an interior cavity formed therein and defining a concave lower surface;

a plurality of electrical contacts spaced apart and extending into said interior cavity each spaced from the lowermost portion of said concave lower surface; and a ball formed of an electrically conductive material having a diameter greater than the spacing between adjacent ones of said contacts.

6. A motion-responsive musical toy as set forth in claim 5 wherein said pluralities of said floor segments, said toy figures and said push operable switches are each three.

* * * * *